US006209339B1

(12) United States Patent
Schroeder et al.

(10) Patent No.: US 6,209,339 B1
(45) Date of Patent: Apr. 3, 2001

(54) MODULAR ICE DELIVERY SYSTEM FOR A BEVERAGE DISPENSER

(75) Inventors: Alfred A. Schroeder; Samuel Durham, both of San Antonio, TX (US)

(73) Assignee: Lancer Partnership, Ltd., San Antonio, TX (US)

( * ) Notice: Subject to any disclaimer, the term of this patent is extended or adjusted under 35 U.S.C. 154(b) by 0 days.

(21) Appl. No.: 09/374,125

(22) Filed: Jul. 26, 1999

(51) Int. Cl.[7] ..... F25C 5/18
(52) U.S. Cl. ..... 62/303; 62/344; 62/400
(58) Field of Search ..... 62/344, 398, 400, 62/303

(56) References Cited

U.S. PATENT DOCUMENTS

| | | | | |
|---|---|---|---|---|
| 3,021,035 | * | 2/1962 | Hill | 62/344 |
| 3,059,450 | * | 10/1962 | Mueller et al. | 62/344 |
| 3,211,338 | | 10/1965 | Weil et al. | 222/70 |
| 3,638,448 | | 2/1972 | Raymer | 62/233 |
| 3,898,861 | | 8/1975 | McMillin | 62/177 |
| 3,995,770 | | 12/1976 | Schwitters | 222/56 |
| 4,104,889 | * | 8/1978 | Hoenisch | 62/344 |
| 4,176,528 | | 12/1979 | Frohbieter | 62/344 |
| 4,328,681 | * | 5/1982 | Sakamoto et al. | 62/344 |
| 4,679,715 | * | 7/1987 | Hovinga | 62/344 |
| 5,000,348 | | 3/1991 | Emody | 222/66 |
| 5,044,171 | | 9/1991 | Farkas | 62/306 |
| 5,433,349 | | 7/1995 | Romanyszyn, Jr. . | |
| 5,542,573 | | 8/1996 | Frantz | 222/129.1 |
| 5,855,295 | | 1/1999 | Lee | 222/1 |
| 5,875,930 | | 3/1999 | Nakajima et al. | 222/129.1 |

* cited by examiner

*Primary Examiner*—William E. Tapolcai
(74) *Attorney, Agent, or Firm*—Christopher L. Makay

(57) ABSTRACT

A modular ice delivery system includes a beverage dispenser unit for dispensing beverages therefrom and an ice delivery unit linked with the beverage dispenser unit for supplying ice to the beverage dispenser unit. A docking pathway formed between the ice delivery unit and the beverage dispenser unit is provided for operatively linking the ice delivery unit with the beverage dispenser unit. The modular ice delivery system may further include an ice capacity booster unit linked with the ice delivery unit, ultimately, for supplying ice to the beverage dispenser unit. A docking pathway formed between the ice delivery unit and the ice capacity booster unit is also provided for linking the ice capacity booster unit and the ice delivery unit. In effect, each docking pathway enables the modular ice delivery system to be broken down into modular units commensurate with varying demand for ice. Additionally, the modular ice delivery system includes a sanitizing system for ensuring the production and dispensing of sanitary ice from the modular ice delivery system.

37 Claims, 3 Drawing Sheets

MODULAR ICE DELIVERY SYSTEM FOR A BEVERAGE DISPENSER

BACKGROUND OF THE INVENTION

1. Field of the Invention

The present invention generally relates to dispensing equipment and, more particularly, but not by way of limitation, to a modular ice delivery system for providing ice to a beverage dispenser unit.

2. Description of the Related Art

Beverage dispensers are often equipped with a drink tower to dispense a variety of popular beverages therefrom. Typically, beverage dispensers feature ice dispensers to complement those beverages dispensed from the drink tower such that consumers expect ice to accompany many of these popular carbonated and non-carbonated drinks.

However, providing a continuous supply of ice has long been problematic, especially if a beverage dispenser is accessed by large volumes of consumers. Current beverage dispensers either require manual ice replenishment by a beverage dispenser attendant or feature automatic icemakers of limited capacity.

In particular, beverage dispensers feature an ice holding chamber for providing a supply of ice to the ice dispenser. Often, ice within the ice holding chamber is replenished by an attendant placing ice directly into the ice holding chamber. In addition to being tedious and labor intensive, manual ice replenishment is hazardous in that consumers and beverage dispenser attendants alike trip and fall on ice that lands on the floor during the replenishment process. Furthermore, manual ice replenishment is less than sanitary due to ice contact with the atmosphere, the replenishment container, and even the attendant.

U.S. Pat. No. 3,211,338, which issued to A. G. Weil et al. on Oct. 12, 1965 and is entitled "Ice Handling Apparatus", features a beverage dispenser with an automatic ice maker. The Weil icemaker is confined within the inner workings of a beverage dispenser unit and, thus, cannot accommodate the unit's ice dispenser with large volumes of ice at any given time. The Weil icemaker imposes a further complication in that it does not include an integrated sanitizing system, which necessitates manual cleaning. Consequently, the Weil icemaker is not suited for placement in a confined space, such as under a counter.

Accordingly, there is a long felt need for a modular ice delivery system that is self-sanitizing and that provides large quantities of ice pursuant to consumer demand.

SUMMARY OF THE INVENTION

In accordance with the present invention, a modular ice delivery system includes a beverage dispenser unit for dispensing beverages therefrom and an ice delivery unit linked with the beverage dispenser unit for supplying ice to the beverage dispenser unit. A docking pathway formed between the ice delivery unit and the beverage dispenser unit is provided for operatively linking the ice delivery unit with the beverage dispenser unit. The modular ice delivery system may further include an ice capacity booster unit linked with the ice delivery unit, ultimately, for supplying ice to the beverage dispenser unit. A docking pathway formed between the ice delivery unit and the ice capacity booster unit is also provided for linking the ice capacity booster unit and the ice delivery unit. In effect, each docking pathway enables the modular ice delivery system to be broken down into modular units commensurate with varying demand for ice.

The ice delivery unit includes an automatic icemaker and the ice capacity booster unit includes a booster icemaker, each for providing a supply of ice for the beverage dispenser unit. As such, the ice delivery unit includes an ice delivery unit transportation element operatively linked with the automatic icemaker for transferring ice from the automatic icemaker to the beverage dispenser unit through the respective docking pathway. In a similar manner, the ice capacity booster unit includes a booster unit ice delivery element operatively linked with the booster ice maker for facilitating the transfer of ice from the booster ice maker to the beverage dispenser unit through the respective docking pathway.

The modular ice delivery system further includes a sanitizing system. The sanitizing system may include a sanitizing line positioned in the beverage dispenser unit, the ice delivery unit, and/or the ice capacity booster unit for ensuring the production and dispensing of sanitary ice from the modular ice delivery system.

In accordance with the present invention, a method for supplying ice includes linking a beverage dispenser unit with an ice delivery unit and supplying ice from the ice delivery unit to the beverage dispenser unit. Similarly, the method may include linking an ice capacity booster unit with the ice delivery unit and, ultimately, supplying ice from the ice capacity booster unit to the beverage dispenser unit. The method may include forming a respective docking pathway from the ice delivery unit to the beverage dispenser unit as well as from the ice capacity booster unit to the ice delivery unit. Thus, as noted above, ice is transferred through each docking pathway via the ice delivery unit transportation element and the booster unit ice delivery element.

Moreover, in accordance with the present invention, a method for sanitizing a modular ice delivery system includes linking a sanitizing line with the modular ice delivery system and dispensing sanitizing mixture from the sanitizing line to the modular ice delivery system. In particular, the modular ice delivery system is flushed with water via the sanitizing line to remove ice in the modular ice delivery system. Sanitizing mixture is discharged from the sanitizing line to sanitize the modular ice delivery system. The modular ice delivery system is flushed with water via the sanitizing line to remove the sanitizing mixture in the modular ice delivery system.

It is therefore an object of the present invention to provide a modular ice delivery system and associated methods for supplying ice from as well as for sanitizing the modular ice delivery system.

It is a further object of the present invention to provide an ice delivery unit and an ice capacity booster unit, whereby each of these modular units is capable of being added to the modular ice delivery system in accordance with varying demand for ice.

Still other objects, features, and advantages of the present invention will become evident to those skilled in the art in light of the following.

DETAILED DESCRIPTION OF THE PREFERRED EMBODIMENT

As required, detailed embodiments of the present invention are disclosed herein, however, it is to be understood that the disclosed embodiments are merely exemplary of the invention, which may be embodied in various forms, the figures are not necessarily to scale, and some features may be exaggerated to show details of particular components or steps.

Figure 1:
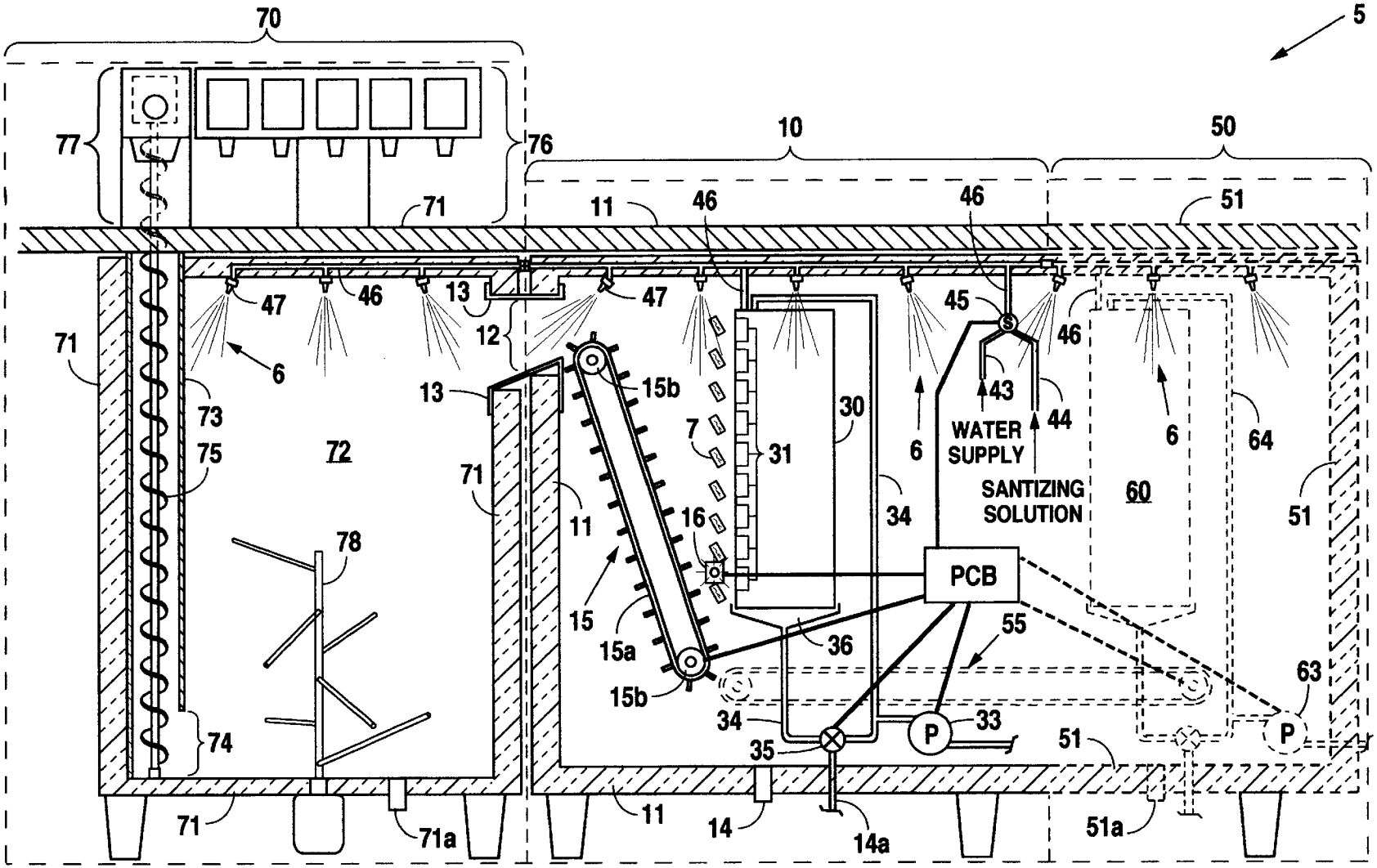
FIG. 1 is a side view illustrating a modular ice delivery system according to the preferred embodiment featuring an ice delivery unit (center) and an ice capacity booster unit (right) engaged with the ice delivery unit, each for supplying ice to a beverage dispenser unit (left).

As illustrated in FIG. 1, a modular ice delivery system 5 includes an ice delivery unit 10 and an ice capacity booster unit 50 linked with the ice delivery unit 10. The ice delivery unit 10 and the ice capacity booster 50 are each engaged with a beverage dispenser unit 10 for supplying ice 7 to the beverage dispenser unit 70.

The beverage dispenser unit 70 is a beverage dispenser system well known to those of ordinary skill in the art. In particular, the beverage dispenser unit 70 includes a dispenser unit housing 71 where the ice 7 is stored. A drink tower 76 is provided atop the dispenser unit housing 71 and through a counter 100 for dispensing a variety of popular beverages therefrom. Similarly, an ice dispenser 77 is provided atop the dispenser housing 71 and through the counter 100 for dispensing the ice 7 therefrom to complement those beverages dispensed from the drink tower 76.

The beverage dispenser unit housing 71 defines an ice holding chamber 72 for storing a supply of the ice 7 for the ice dispenser 77. The ice 7 is brought from the ice holding chamber 72 to the ice dispenser 77 via a dispenser unit ice delivery element 75. Although shown in FIG. 1 as a screw, as is preferred, the dispenser unit ice delivery element 75 may be any suitable means for delivering the ice 7 from the ice holding chamber 72 to the ice dispenser 77 as those skilled in the art will recognize. The dispenser unit ice delivery element 75 may include a guard plate 73 disposed along the ice holding chamber 72 to prevent unwanted ice within the ice holding chamber 72 from interfering with the delivery of ice by the dispenser unit ice delivery element 75. Furthermore, the beverage dispenser unit 70 may include an ice agitator 78 disposed within the ice holding chamber 72 for facilitating free flow of the ice 7 from the ice holding chamber 72 through the dispenser unit ice delivery element 75 to the ice dispenser 77.

In operation, the ice 7 enters the ice holding chamber 72 and collects therein until the ice dispenser 77 is activated. Upon activation, the ice 7 from the ice holding chamber 72 enters the dispenser unit ice delivery element 75 via an opening 74 formed between the guard plate 73 and the beverage dispenser unit housing 71. The ice 7 is thus delivered to the beverage dispenser 77 via the dispenser unit ice delivery element 75 where it is dispensed therefrom.

Figure 2:
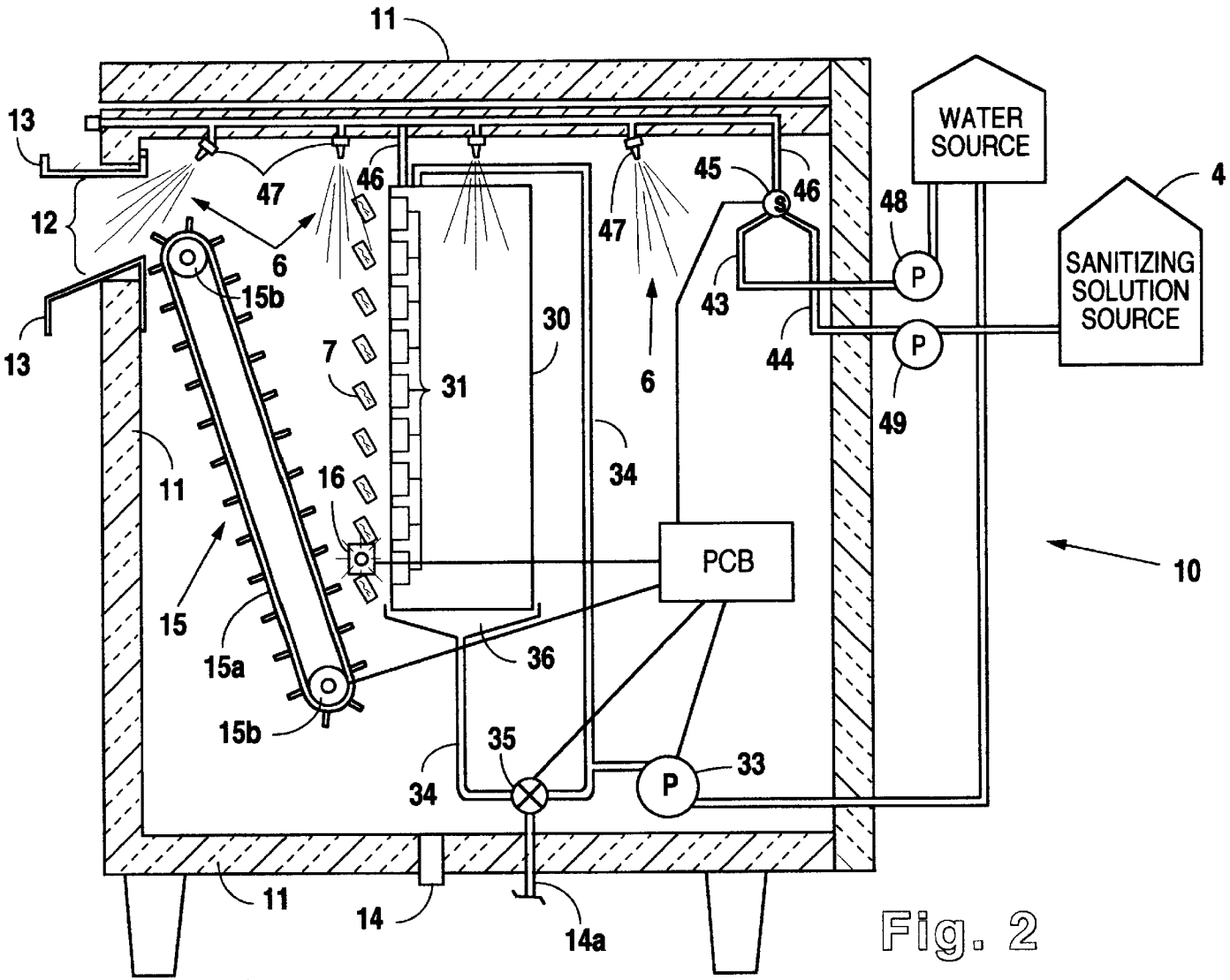
FIG. 2 is a side view illustrating an ice delivery unit according to the preferred embodiment for providing ice to a modular ice delivery system.

FIG. 2 illustrates the preferred ice delivery unit 10 for providing large quantities of ice in accordance with consumer demand. The ice delivery unit 10 includes a delivery unit housing 11 where the ice 7 is formed via an automatic ice maker 30 and a sanitizing system where the preferred sanitizing operation is executed via a logic unit 20.

Each delivery unit housing 11 defines at least one docking pathway 12 for linking the ice delivery unit 10 with the beverage dispenser unit 70 and/or the ice capacity booster unit 50, thereby enabling the modular ice delivery system 5 to be broken down into component or "modular" units commensurate with varying consumer demand for ice with their beverages. Inasmuch, unlike current beverage dispensers with automatic ice makers, the capacity of automatic ice maker 30 can be varied by removing the ice delivery unit 10 in exchange for another ice delivery unit with an ice maker of larger or smaller capacity.

Moreover, as illustrated in FIG. 1, where consumer demand for ice is high, at least one ice capacity booster unit 50 can be linked with the ice delivery unit 10, whereby each ice capacity booster unit is equipped with at least one booster ice maker 60 and booster unit ice delivery element 55 for supplying ice to the beverage dispenser unit 70. The ice delivery unit transportation element 15 transfers the ice 7 received from the booster unit ice delivery element 55 to the ice holding chamber 72 within the beverage dispenser unit 70. In the preferred embodiment, the booster unit ice delivery element 55 and the ice delivery unit transportation element 15 are operatively linked with one another so that the ice 7 is delivered along a continuous path from the booster ice maker 60 to the ice holding chamber 72.

As shown in FIG. 2, coupling plates 13 are provided along the docking pathway 12 for securing the ice delivery unit 10 with the beverage dispenser unit 70. In addition, the coupling plates 13 act as a "chute" for the ice 7 entering into the ice holding chamber 72 by providing a surface that facilitates ease of movement for the ice 7 traversing the junction between the ice delivery unit 10 and the beverage dispenser unit 70.

The automatic icemaker 30 is an automatic icemaker well known to those of ordinary skill in the art. Specifically, in the preferred embodiment, the automatic icemaker 30 includes an array of ice cube moulds 31 formed by the automatic icemaker 30. As such, the automatic ice maker 30 subjects the array of ice moulds 31 to freezing temperatures such that the ice 7 is formed by the deposition of liquid water therein.

An ice delivery unit pump 33 delivers liquid water from a water source 3 to the automatic icemaker 30 via a water line 34. Thus in operation, water from the water line flows over the array of ice cube moulds 31. Water nearest the freezing surface of the array of ice cube moulds 31 is frozen first, thereby establishing a first ice deposition layer therein. Remaining unfrozen water drains from the automatic icemaker 30 and collects in a collecting pan 36 linked with the automatic icemaker 30. Water from the collecting pan 36 reenters the water line 34 linked with the collecting pan 36 and is pumped to the automatic ice dispenser 30 to establish a second ice deposition layer therein. This cycle is continued until the liquid water is exhausted, thereby forming an ice cube on each ice cube mould from the array of ice cube moulds 31. Thereafter, the ice 7 from the array of ice cube moulds 31 is discharged from the automatic icemaker 30 and collects within the delivery unit housing 11. This above described ice formation process is repeated to ensure that enough ice is generated to satisfy consumer demand.

A logic unit 20 is provided by the ice delivery unit 10 to execute the above ice formation process. The logic unit 20, linked with the ice delivery unit pump 33, enables the ice delivery unit pump 33 to repetitiously draw a sufficient amount of water from the water source 3 to form ice cubes within the array of ice cube moulds 31, to regulate the temperature of the array of ice cube moulds 31 as well as to discharge ice therefrom. In the preferred embodiment, logic unit 20 comprises a printed circuit board having a microcontroller and associated circuitry well known to those of ordinary skill in the art.

Once a sufficient amount of ice has accumulated within the delivery unit housing 11, the logic unit 20 activates an ice delivery unit transportation element 15 disposed within the delivery unit housing 11 to deliver the ice 7 to the docking pathway 12. Specifically, a desired amount of ice is detected by a sensor 16 linked with the logic unit 20 and engaged with the ice 7 within the delivery unit housing 11. The ice 7 is thus transferred by the ice delivery unit transportation element 15 from the ice delivery unit 10 to the ice holding chamber 72 within the beverage dispenser unit 70.

As shown in FIGS. 1–2, the preferred ice delivery unit transportation element 15 includes a conveyor belt 15 that travels between two opposing rollers 15*b*. As those skilled in the art will recognize, the ice delivery transportation element 15 may be any suitable means for delivering the ice 7 from the delivery unit housing 11 to the docking pathway 12.

In the preferred embodiment, the sensor 20 comprises a photodetector and emitter pair for determining height of the ice 7 within the delivery unit housing 11, whereby the logic unit 20 activates the ice delivery unit transportation element 15 when a desired height is detected by the sensor 20. It should be added that those of ordinary skill in the art will recognize other suitable means for detecting a sufficient amount of ice within the ice delivery unit 10.

Like other commercially available automatic icemakers, the automatic icemaker 30 requires periodic cleaning to ensure the production and dispensing of sanitary ice. However, unlike many automatic ice makers and beverage dispenser systems that require disassembly for sanitizing, the modular ice delivery system 5 includes a sanitizing system operated by the logic unit 20 that requires no disassembly of the modular ice delivery system 5.

The sanitizing system includes a water inlet line 43 and a sanitizing solution inlet line 44. As shown in FIG. 2, water within the water inlet line 43 is drawn from the water source 3 by a water inlet pump 48 linked with the water inlet line 43. Similarly, sanitizing solution within the sanitizing solution inlet line 44 is drawn from a sanitizing solution source 4 by a sanitizing solution inlet pump 49. It should be added that in the preferred embodiment, sanitizing solution is combined with water to obtain a sanitizing mixture 6 suitable for use by the modular ice delivery system 5. Other embodiments, however, contemplate the modular ice delivery system 5 obtaining a sanitizing mixture from a premixed sanitizing mixture source rather mixing water and sanitizing solution as in the preferred embodiment.

As such, water from the water inlet line 43 and sanitizing solution from the sanitizing solution inlet line 44 are each introduced into a sanitizing line 46 linked with the water inlet line 43 and the sanitizing solution inlet line 44, thereby mixing water and sanitizing solution to form and dispense the sanitizing mixture 6 therefrom. An inlet valve 45 linked with the water inlet line 43, the sanitizing solution inlet line 44, and the sanitizing solution line 46 is provided for controlling the formation of the sanitizing mixture 6. The inlet valve 45 is operatively linked with the logic unit 20, whereby the logic unit 20 regulates the formation and dispensing of the sanitizing mixture 6 via inlet valve 45. In the preferred embodiment, the inlet valve 45 comprises a solenoid.

FIG. 1 shows the sanitizing line 46 configured along the ice delivery unit 10, the beverage dispenser unit 70, and the ice capacity booster unit 50 as is preferred. By dispensing the sanitizing mixture 6 therefrom, the sanitizing line 46 sanitizes the entire modular ice delivery system 5, especially the holding chamber 72, the automatic ice maker 30 within the ice delivery unit 10, and the booster ice maker 60 within the ice capacity booster unit 50. The sanitizing line 46 includes dispensing nozzles 47 coupled with the sanitizing line 46 for dispensing the sanitizing mixture 6 therefrom.

Operatively, the sanitizing system employs the following procedure. First, all the ice 7 within the modular ice delivery system 5 is flushed from the system. As such, the logic unit 20 activates the water inlet pump 48 and opens the inlet valve 45 so that water enters and is dispensed from the sanitizing line 46, thereby melting the ice 7 within the modular ice delivery system 5. After flushing the modular ice delivery system 5 with water, the logic unit 20 deactivates the water inlet pump 48 and closes the inlet valve 45. Water drains from the modular ice delivery system 5, via an ice delivery unit drainage passageway 14 formed by the delivery unit housing 11, a beverage dispenser unit drainage passageway 71*a* formed by the beverage dispenser unit housing 71, and a booster unit drainage passageway 51*a* formed by a booster unit housing 51 of the ice capacity booster unit 50.

The logic unit 20 opens the inlet valve 45 and activates the water inlet pump 48 and the sanitizing solution inlet pump 49 to thus form the sanitizing mixture 6 within the sanitizing line 46. The modular ice delivery system 5 is flushed with the sanitizing mixture 6, thereby removing unfavorable impurities therefrom. The sanitizing mixture 6 is allowed to drain from the modular ice delivery system 5 through the ice delivery unit drainage passageway 14, the beverage dispenser unit drainage passageway 71*a*, and the booster unit drainage passageway 51*a*. The modular ice delivery system 5 is then flushed with water as described above.

In a similar manner, in addition to sanitizing the modular ice delivery system 5, the preferred sanitizing line 46 is linked and in communication with the automatic ice maker 30 for sanitizing therein. Inasmuch, ice within the automatic icemaker 30 is first flushed out. The logic unit 20 activates the water inlet pump 48 and opens the inlet valve 45 so that water enters and is dispensed from the sanitizing line 46 to the automatic ice maker 30 to melt ice within the automatic ice maker 30. The logic unit 20 further opens an ice maker outlet drain valve 35 operatively linked with the logic unit 20 as well as linked and in communication with the water line 34 to permit the draining of the collecting pan 36. After flushing the modular ice delivery system 5 with water, the logic unit 20 deactivates the water inlet pump 48 and closes the inlet valve 45.

The logic unit 20 opens the inlet valve 45 and activates the water inlet pump 48 and the sanitizing solution inlet pump 49 to thus form the sanitizing mixture 6 within sanitizing line 46. The automatic icemaker 30 is flushed with the sanitizing mixture 6, thereby removing unfavorable impurities from the automatic icemaker 30. The sanitizing mixture 6 is allowed to drain through the automatic ice maker 30 via the collecting pan 36 and out the ice delivery unit 10 via the drain valve drainage passageway 14*a*. The automatic icemaker 30 is then flushed with water in the manner described above at least once to ensure that the sanitizing mixture 6 is removed therefrom. Once the automatic icemaker 30 has been sufficiently flushed with water, the logic unit 20 closes the ice maker outlet drain valve 35.

Figure 3:
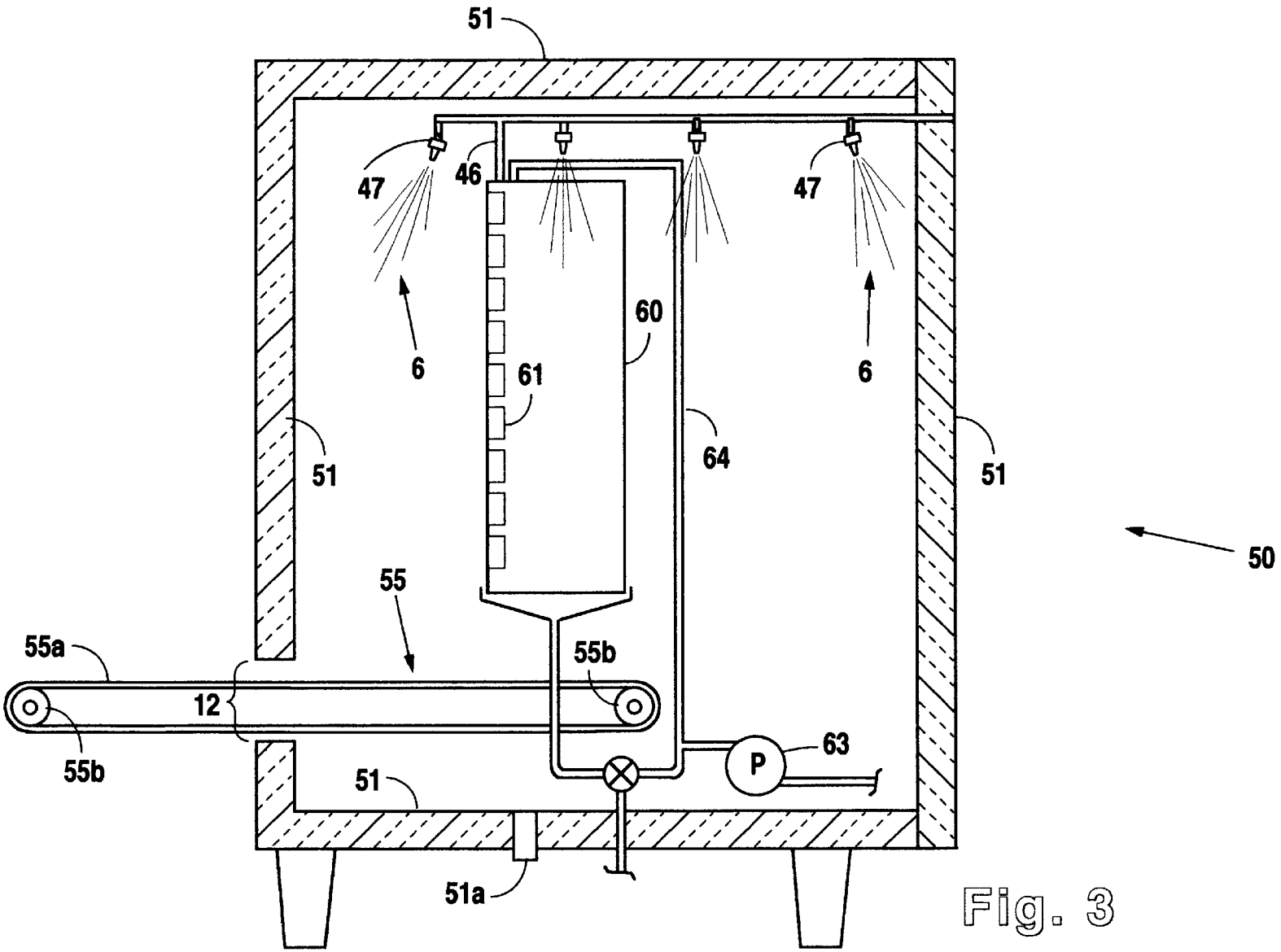
FIG. 3 is a side view illustrating an alternative ice capacity booster unit according to the preferred embodiment for providing ice to a modular ice delivery system.

FIG. 3 illustrates an alternative ice capacity booster unit 50 for providing large quantities of ice when the consumer demand for ice surpasses the capacity of the ice delivery unit 10. In many respects, the ice capacity booster unit 50 is similar to the ice delivery unit 10.

The ice capacity booster unit 50 includes a booster unit housing 51 where the ice 7 is formed via the booster icemaker 60. Each booster unit housing 51 defines at least one docking pathway 12 for linking the ice capacity booster unit 50 with the ice delivery unit 10 or with another ice capacity booster unit. Moreover, where consumer demand for ice is high, other embodiments of the modular ice delivery system 5 contemplate incorporating a plurality of ice makers within the ice capacity booster unit 50 or integrating a plurality of ice capacity booster units to provide ice therefrom.

In the same manner as the ice delivery unit 10, the ice capacity booster unit 50 includes the booster ice maker 60 with an array of ice cube moulds 61 formed by the booster ice maker 60. As such, the booster icemaker 60 subjects the array of ice moulds 61 to freezing temperatures such that ice is formed by the deposition of liquid water therein in the same manner described above. Furthermore, an ice delivery unit pump 63 is provided for delivering liquid water from the water source 3 to the booster icemaker 60 across a water line 64.

The sanitizing system from the ice delivery unit 10 is linked with the ice capacity booster unit 50 such that the sanitizing line 46 provides the sanitizing mixture 6 to the ice capacity booster unit 50. The sanitizing mixture 6 is dispensed from the sanitizing line 46 throughout the ice capacity booster unit 50 as well as through the booster icemaker 60 in the same manner described for the ice delivery unit 10.

As shown in FIG. 3, the ice capacity booster unit 50 includes a booster unit ice delivery element 55 generally disposed within the booster unit housing 51 for transporting ice from the booster ice maker 60 through the docking pathway 12 to the ice delivery unit 10. Ultimately, while within the ice delivery unit 10, the ice delivery unit transportation element 15 transfers the ice 7 received from the booster unit ice delivery element 55 to the ice holding chamber 72 within the beverage dispenser unit 70 in the manner described above. In the preferred embodiment, the booster unit ice delivery element 55 and the ice delivery unit transportation element 15 are operatively linked with one another so that the ice 7 is delivered along a continuous path from the booster ice maker 60 to the ice holding chamber 72.

Although the present invention has been described in terms of the foregoing embodiment, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing description, rather, it is defined only by the claims that follow.

We claim:

1. A modular ice delivery system, comprising:

a beverage dispenser unit including a dispenser unit housing defining an ice holding chamber;

an ice delivery unit including a unit housing, wherein the ice delivery unit supplies ice to the ice holding chamber of the beverage dispenser unit; and a docking pathway operatively linking the unit housing of the ice delivery unit with the dispenser unit housing of the beverage dispenser unit.

2. The modular ice delivery system according to claim 1 wherein the docking pathway enables the modular ice delivery system to be broken down into modular units commensurate with varying demand for ice.

3. The modular ice delivery system according to claim 1 wherein the ice delivery unit comprises an automatic ice maker for providing a supply of ice to the beverage dispenser unit.

4. The modular ice delivery system according to claim 3 wherein the ice delivery unit further comprises an ice delivery unit transportation element operatively linked with the automatic ice maker for transferring ice from the automatic ice maker to the beverage dispenser unit through the docking pathway.

5. The modular ice delivery system according to claim 1 further comprising a sanitizing system.

6. The modular ice delivery system according to claim 5 wherein the sanitizing system includes a sanitizing line positioned in the ice delivery unit for dispensing sanitizing mixture therefrom.

7. The modular ice delivery system according to claim 5 wherein the sanitizing system includes a sanitizing line positioned in the beverage dispenser unit for dispensing sanitizing mixture therefrom.

8. The modular ice delivery system according to claim 3 further comprising a sanitizing system.

9. The modular ice delivery system according to claim 8 wherein the sanitizing system includes a sanitizing line linked with the automatic icemaker for dispensing sanitizing mixture therethrough, thereby sanitizing the automatic icemaker.

10. A modular ice delivery system, comprising:

a beverage dispenser unit including a dispenser unit housing defining an ice holding chamber;

an ice delivery unit including a unit housing, wherein the ice delivery unit supplies ice to the ice holding chamber of the beverage dispenser unit;

a docking pathway operatively linking the unit housing of the ice delivery unit with the dispenser unit housing of the beverage dispenser unit; and an ice capacity booster unit linked with the ice delivery unit.

11. The modular ice delivery system according to claim 10 further comprising a sanitizing system.

12. The modular ice delivery system according to claim 11 wherein the sanitizing system includes a sanitizing line positioned in the ice delivery unit for dispensing sanitizing mixture therefrom.

13. The modular ice delivery system according to claim 11 wherein the sanitizing system includes a sanitizing line positioned in the ice capacity booster unit for dispensing sanitizing mixture therefrom.

14. The modular ice delivery system according to claim 11 wherein the sanitizing system includes a sanitizing line positioned in the beverage dispenser unit for dispensing sanitizing mixture therefrom.

15. The modular ice delivery system according to claim 10 wherein the ice delivery unit comprises an automatic ice maker for providing a supply of ice to the beverage dispenser unit.

16. The modular ice delivery system according to claim 15 wherein the ice delivery unit further comprises an ice delivery unit transportation element operatively linked with the automatic ice maker for transferring ice from the automatic ice maker to the beverage dispenser unit through the first docking pathway.

17. The modular ice delivery system according to claim 16 wherein the ice capacity booster unit comprises a booster ice maker for providing a supply of ice to the beverage dispenser unit.

18. The modular ice delivery system according to claim 17 wherein the ice capacity booster unit further comprises a booster unit ice delivery element operatively linked with the booster ice maker for transferring ice from the booster ice maker to the ice delivery unit transportation element.

19. The modular ice delivery system according to claim 18 further comprising a sanitizing system.

20. The modular ice delivery system according to claim 19 wherein the sanitizing system includes a sanitizing line linked with each automatic icemaker for dispensing sanitizing mixture therethrough, thereby sanitizing each automatic icemaker.

21. The modular ice delivery system according to claim 10 further comprising a second docking pathway formed between the ice delivery unit and the ice capacity booster unit for operatively linking the ice capacity booster unit and the ice delivery unit.

22. The modular ice delivery system according to claim 21 wherein the first and second docking pathways enable the modular ice delivery system to be broken down into modular units commensurate with varying demand for ice.

23. The modular ice delivery system according to claim 21 wherein the ice delivery unit comprises an automatic ice maker for providing a supply of ice to the beverage dispenser unit.

24. The modular ice delivery system according to claim 23 wherein the ice delivery unit further comprises an ice delivery unit transportation element operatively linked with the automatic ice maker for transferring ice from the automatic ice maker to the beverage dispenser unit through the first docking pathway.

25. The modular ice delivery system according to claim 24 wherein the ice capacity booster unit comprises a booster ice maker for providing a supply of ice to the beverage dispenser unit.

26. The modular ice delivery system according to claim 25 wherein the ice delivery unit further comprises a booster unit ice delivery element operatively linked with the booster ice maker for transferring ice from the booster ice maker to the ice delivery unit transportation element through the second docking pathway.

27. The modular ice delivery system according to claim 26 wherein the booster unit ice delivery element and the ice delivery unit transportation element are operatively linked with one another, whereby ice is delivered along a path from the booster ice maker to the beverage dispenser unit.

28. The modular ice delivery system according to claim 25 further comprising a sanitizing system.

29. The modular ice delivery system according to claim 28 wherein the sanitizing system includes a sanitizing line linked with each automatic icemaker for dispensing sanitizing mixture therethrough, thereby sanitizing each automatic icemaker.

30. A method of supplying ice in a modular ice delivery system, comprising the steps of:

providing a beverage dispenser unit including a dispenser unit housing defining an ice holding chamber;

providing an ice delivery unit including a unit housing;

forming a docking pathway operatively linking the unit housing of the ice delivery unit with the dispenser unit housing of the beverage dispenser unit; and supplying ice from the ice delivery unit to the ice holding chamber of the beverage dispenser unit.

31. The method according to claim 30 wherein forming a docking pathway enables the modular ice delivery system to be broken down into modular units commensurate with varying demand for ice.

32. The method according to claim 31 wherein the step of linking a beverage dispenser unit with an ice delivery unit further comprises the step of:

transferring ice in the ice delivery unit through the docking pathway to the beverage dispenser unit via an ice delivery unit transportation element of the ice delivery unit.

33. The method according to claim 30 wherein the step of linking a beverage dispenser unit with an ice delivery unit further comprises the step of:

incorporating an automatic icemaker with the ice delivery unit for providing a supply of ice to the ice delivery unit.

34. The method according to claim 30, further comprising the steps of:

linking an ice capacity booster unit with the ice delivery unit; and supplying ice from the ice capacity booster unit to the beverage dispenser unit, whereby ice is delivered from the ice capacity booster unit through the ice delivery unit to the beverage dispenser unit.

35. The method according to claim 34 wherein the step of linking an ice capacity booster unit with the ice delivery unit comprises the step of:

forming a docking pathway from the ice capacity booster unit to the ice delivery unit, thereby enabling the modular ice delivery system to be broken down into modular units commensurate with varying demand for ice.

36. The method according to claim 35 wherein the step of linking an ice capacity booster unit with the ice delivery unit further comprises the step of:

transferring ice in the ice capacity booster unit through the docking pathway to the ice delivery element via a booster unit ice delivery element of the ice capacity booster unit.

37. The method according to claim 34 wherein the step of linking an ice capacity booster unit with the ice delivery unit further comprises the step of:

incorporating a booster icemaker with the ice capacity booster unit for providing a supply of ice to the ice capacity booster unit.

* * * * *